US005180210A

United States Patent [19]

Lister

[11] Patent Number: 5,180,210

[45] Date of Patent: Jan. 19, 1993

[54] CHISELING APPARATUS

[76] Inventor: David M. Lister, 3380 Blacklick Eastern Rd., Baltimore, Ohio 43105

[21] Appl. No.: 685,054

[22] Filed: Apr. 15, 1991

[51] Int. Cl.[5] ..... E21C 37/26; F23J 3/00

[52] U.S. Cl. ..... 299/70; 15/104.07; 15/242; 299/94

[58] Field of Search ..... 299/37, 38, 69, 70, 299/94; 15/93.1, 242, 243, 249, 104.07; 29/81.16

[56] References Cited

U.S. PATENT DOCUMENTS

| | | | |
|---|---|---|---|
| 873,209 | 12/1907 | Busch | 299/69 |
| 929,489 | 7/1909 | Ratcliffe | 15/104.07 |
| 1,544,635 | 7/1925 | De Graff | 15/242 |
| 1,884,653 | 10/1932 | Gartin | 299/37 X |
| 2,454,884 | 11/1948 | Peaden | 4/255 |
| 4,408,368 | 10/1983 | Vickery | 15/243 |
| 4,492,000 | 1/1985 | Sskogen | 15/242 |
| 4,498,212 | 2/1985 | Davis | 15/242 |
| 4,603,747 | 8/1986 | Golden | 15/249 X |
| 4,624,712 | 11/1986 | Neumann et al. | 15/242 X |
| 4,937,939 | 7/1990 | Fisher | 15/242 X |

*Primary Examiner*—David J. Bagnell

[57] ABSTRACT

A piston and cylinder combination mounted on the end of an elongated handle projects into a chimney. A chisel is connected to the piston to reciprocate with the piston in response to high pressure air delivered to the cylinder. The chisel has a cutting edge which is offset from the axis of the piston to facilitate the chiseling of objections on the inside of a chimney.

12 Claims, 2 Drawing Sheets

CHISELING APPARATUS

FIELD OF THE INVENTION

This invention relates to chiseling apparatus for use on the inside of a chimney, a process for relining a chimney, and a process for assembling chiseling apparatus.

BACKGROUND OF THE INVENTION

Residential fireplaces include a firebox which is ordinarily open for wood or other fireplace fuel and the smoke and other gases are drawn from the firebox through a chimney allowing exit to the exterior of the dwelling. The firebox is ordinarily constructed of masonry, lined with a metal box which is in turn lined with fire brick. The chimney is ordinarily a masonry structure lined with a refractory tube designed to provide a passage for smoke and other combustion gases while preventing the gases from direct contact with the exterior masonry surfaces.

Replacement of fire brick and repair of the firebox itself is a relatively simple matter because it is easily accessible to the worker. However, imperfections, cracks, breaks, mortar deterioration, and the like which occur within the chimney itself are often not easily accessible and repairs become both difficult and expensive. Often the only solution to chimney liner deterioration is to dismantle and completely rebuild the chimney.

At least one known apparatus for removing chimney linings includes a heavy rotatable tool which is lowered into the chimney and, while rotating, the tool is designed to strike the lining and crush it. Unfortunately, the tool does not discriminate between the lining and the exterior support brick. As a result the tool sometimes damages the brickwork and even more extensive repairs are required.

There is a need in the industry for apparatus which will allow the scraping, cleaning and smoothing of the inside of a chimney to remove the old defective liner and replace it without having to dismantle all of the brick work.

SUMMARY OF THE INVENTION

This invention has solved that problem by providing a chisel on the end of an elongated handle which may be lowered into the chimney from the roof and which will chisel the lining from the interior of the chimney without damaging the brickwork and allow replacement of the lining.

The tool of this invention includes a piston and cylinder combination mounted within a cylindrical housing. The housing is secured to the lower end of the handle. The chisel itself is secured to the piston and designed to reciprocate with the piston in a vertical direction in response to air under pressure fed to the cylinder.

The chisel has a cutting edge on its lower end and the cutting edge is offset from the axis of the piston as a result of an angled leg portion on the chisel intermediate the piston and cutting edge. The cutting edge is formed as an elongated chisel point and has two functions; the first is to cut through obstructions projecting within the chimney from the chimney sidewall such as mortar between bricks which has slopped over into the chimney interior during chimney construction. The sharp tapered chisel edge will be strategically placed to impact on its upper surface, and through vertical reciprocation by the piston and cylinder combination, the chisel will sever the protruding cementitious obstruction.

The second function of the tapered chisel point with the offset is to slide between the chimney liner and the chimney brick sidewall, and as the chisel reciprocates up and down with the piston, the angled leg in the chisel body serves as a lever between the brick sidewall and piston which crushes the lining toward the inside of the chimney. Thereby the broken pieces of lining are pushed inward to fall by gravity into the firebox or any other substrate which may be mounted in the chimney area below the chiseling activity.

The upper or hand held end of the handle is manipulated manually by the worker who will be standing on the roof, scaffolding, or other support. The worker will also control the air feed to the piston and cylinder combination by means of a valve which is connected to a hose leading to the cylinder from an air compressor or the like. In any case, a source of high pressure air must be available to actuate the piston and cylinder combination for best use of this invention.

After the liner has been chiseled from the chimney interior, the chisel will also be used to smooth the interior surface by chiseling away the aforementioned mortar bulges which sometimes project into the chimney cavity.

After the smoothing takes place, a flexible inflatable concrete form is inserted into the chimney leaving a narrow gap between the concrete form and the brick sidewall of the chimney and a cementitious or refractory grout is poured into the narrow gap. After the grout sets, the inflatable concrete form is deflated and extracted from the chimney proper. Subsequently, imperfections, rough spots, and cracks in the new lining are repaired by a trowel which may be on the end of a similar elongated handle as initially supported the chiseling apparatus.

The construction of the chiseling apparatus takes a specialized form in that a conventional air gun involving a piston and cylinder combination is mounted within a hollow cylindrical housing which housing is in turn designed to be mounted on one end of the aforementioned handle. In assembling the piston and cylinder combination into the housing, a depth limiting seat is constructed on the inside of the cylinder in a pre-designated assembly relationship with an opening through the sidewall of the housing.

Before the conventional air gun is inserted into the housing, the conventional lever type actuating handle is removed leaving exposed only the button which must be depressed to actuate the reciprocation mechanism for the piston within the cylinder. The cylinder includes an opening through one end which is constructed to receive high pressure air. A right angle elbow is threaded into the cylinder opening and tightened sufficiently to maintain air pressure integrity without leaks and to a position that the threaded opening or mouth of the right angle elbow faces 180° from the direction faced by the actuation button for the air gun. Whatever the angle relationship is between the elbow and the actuation button (if it is not the preferred 180°) the standard may be set by the worker.

The piston and cylinder combination is inserted into the housing, elbow end first until the elbow reaches the depth specified to be aligned with the opening through the housing sidewall. That will place the center of the elbow mouth in a plane which passes through the center of the opening through the housing sidewall. Then the cylinder is rotated with respect to the housing until the threaded mouth of the elbow is visible through the sidewall opening. Then a second right angle elbow is inserted through the housing sidewall opening into the mouth and threadedly engages the first elbow to form an air feed from outside the housing into the cylinder.

Objects of the invention not clear from the above discussion will be clear upon a review of the drawings and the description of the preferred embodiment which follow.

DESCRIPTION OF THE PREFERRED EMBODIMENT

Figure 1:
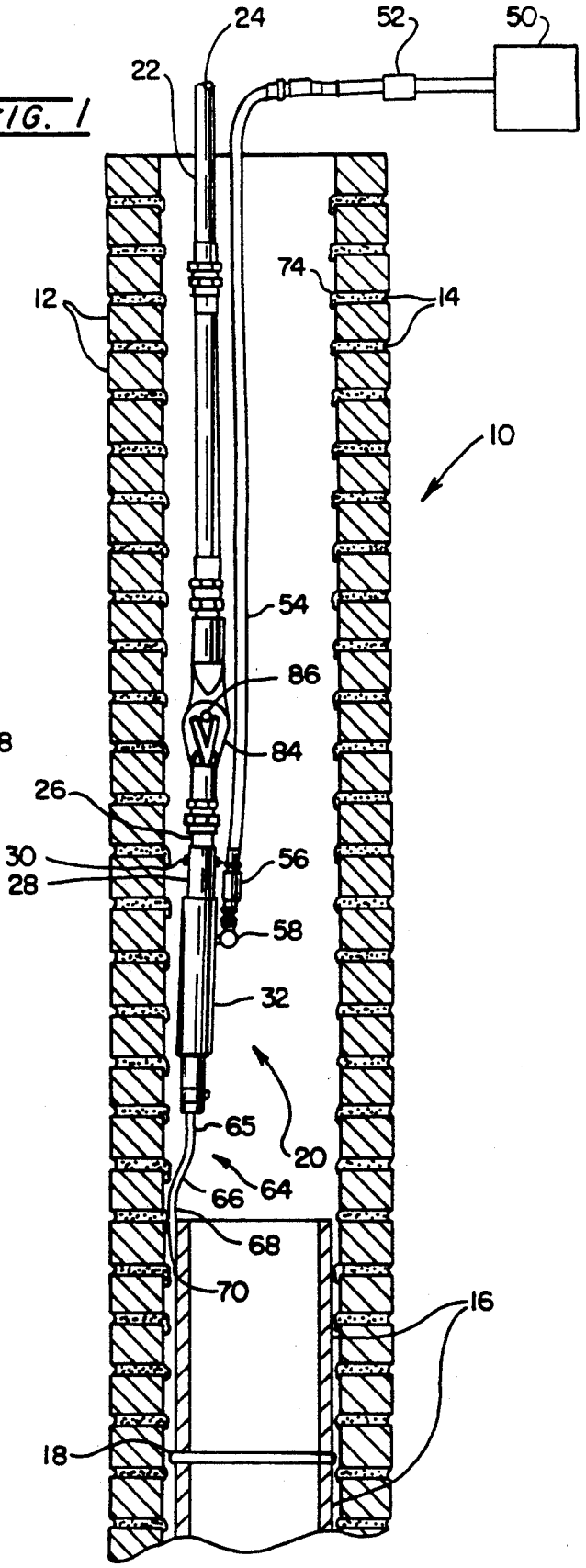
FIG. 1 is a sectional view through a chimney having a lining and with a chiseling apparatus, according to this invention, inserted into the chimney from above.

Looking to FIG. 1, a chimney 10 is constructed of masonry bricks 12 which are secured together in conventional form by a cementitious mixture of portland cement, sand and water 14. The chimney is designed to receive and discharge smoke and other combustion gases from a fireplace 15, best seen in FIG. 3.

During construction of the chimney, it will be lined by stackable units 16 about two feet high bonded together in series by mortar joints 18. The procedure for constructing the chimney with the lining 16 is not a part of this invention and will not be described here. Its construction is well known in the art.

After some years of use it is inevitable that the lining 16 and/or the mortar joints 18 will begin to deteriorate due to thermal cycling and the corrosiveness of the combustion gases passing therethrough. Defective workmanship could be a contributing factor but whether or not that is a fact, lining deterioration will occur, for whatever reason. When cracks and deteriorating mortar joints become a fact it is desirable to replace the lining with a new lining to maintain the operative status of the chimney without abridging the margin of safety required by home owners using fireplaces.

To accomplish the desired result this invention provides an apparatus for chiseling out and breaking the lining 16 to allow a smoothing of the interior of the chimney sidewall, an insertion of a concrete mold, a relining of the chimney, and after the lining has set the concrete mold is removed and the chimney is ready for reuse.

The apparatus for removing the chimney includes a chiseling apparatus 20 supported by an elongated handle 22 having a handle end 24 and a free end 26. The handle end 24 will project above the upper end of the chimney to be hand manipulated by the worker and the lower end will be guided into place by the worker by virtue of the elongated handle 22.

Figure 2:
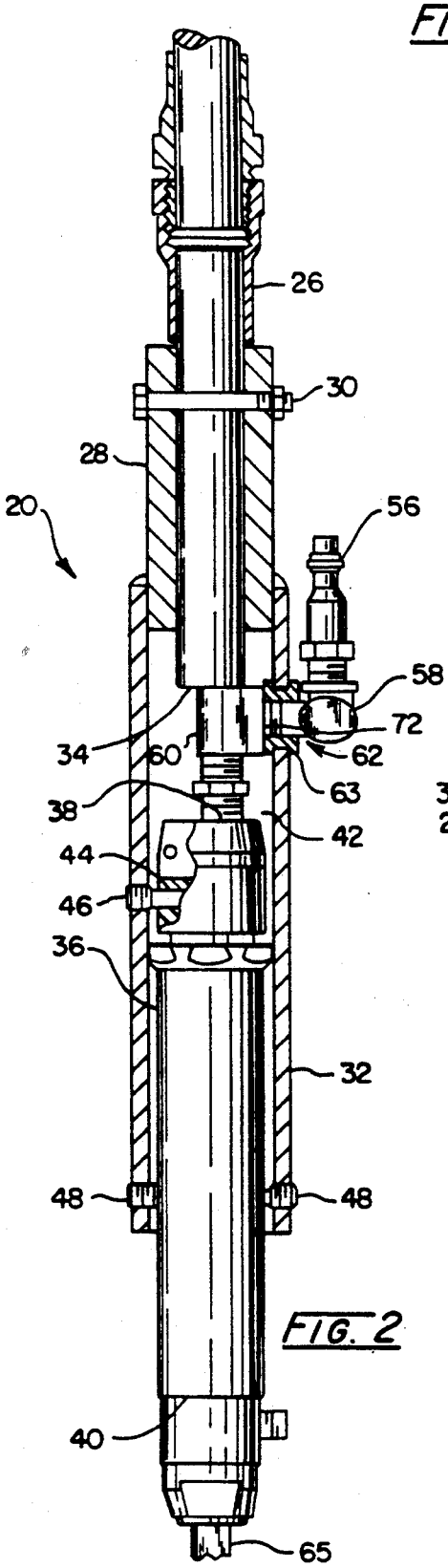
FIG. 2 is a fragmentary sectional view showing the chiseling apparatus of this invention.

In the preferred embodiment, the numerous segments of handle 22 are threaded together at their ends by conventional fittings which need not be described. In the preferred embodiment handle segments are wooden and that has three benefits, namely, relative rigidity, light weight and thermally and electrically non-conducting. The chiseling apparatus 20 mounted on the lower end of the handle 22 includes a sleeve 28 secured to the free end 26 of the handle by a nut and bolt combination 30, see FIG. 2, to prevent relative longitudinal displacement and relative rotational movement between the handle and an attached cylindrical housing 32. Housing 32 is welded to sleeve 28 and includes an impact absorbing or depth limiting seat 34 whose function will be explained subsequently.

A conventional air gun 36 is mounted in housing 32 and includes a piston and cylinder combination along with the usual apparatus to receive air under pressure and cause the reciprocation of the piston within the cylinder. The detailed structure of the air gun 36 is well known, is readily commercially available and will not be discussed here. It does include an air inlet opening 38 on the end inserted first into the housing 32 and a piston rod opening 40 at the opposite end. Before the air gun 36 is inserted into the cavity 42 formed by the housing 32, the conventional actuation lever is removed leaving the button 44 exposed. The manner for depressing button 44 will be discussed subsequently in relation to the assembly of the apparatus, but it should be stated that a set screw 46 is aligned with button 44 and is tightened through a threaded opening in housing 32 to keep the button 44 constantly depressed, whereby, the air gun will operate continuously when air is received through inlet opening 38. The air gun 36 is centered within the housing 32 and held in place against axial or rotational movement by a plurality of set screws 48 threaded through the sidewall of the housing 32.

Air is fed to the air gun 36 through a duct extending from a source of high pressure air 50 leading to a valve 52 disposed adjacent the worker at the top of chimney, thereby the worker can manually start or stop the operation of air gun 36. The duct leading from valve 52 to air gun 36 is in the form of a flexible hose 54 connected by a standard quick connect fitting 56 to a right angle elbow 58 which in turn is threadedly connected to another right angle elbow 60 within the housing 32. Elbow 60 is directly or indirectly connected to the air inlet opening 38 in the air gun 36. Elbow 58 projects from outside housing 32 through an opening 62 in housing sidewall in a particular manner which will be explained subsequently. A circular grommet 63 fits in opening 62 to cushion elbow 58 against the impacts of the reciprocating piston.

Attached to the exposed lower end of the piston is a chisel 64 constructed to operate in combination with the reciprocating piston to remove old lining from inside the chimney 10. The chisel 64 includes a section 65 coaxially aligned with the piston, angled portion 66 and an offset section 68 which extends parallel with coaxial section 65 and terminates in a sharp chisel edge 70, in this case shown projecting between the brick sidewall of the chimney and the outer edge of the liner 16.

In assembling the chiseling apparatus 20, the housing 32 is provided with the threaded openings for set screws 48 and with the transversely extending opening 62. Next the air gun 36 is provided with the usual handle removed leaving the button 44 exposed. The air gun is to be inserted into the cavity 42 of housing 32 but before that takes place the elbow 60 is installed.

In preparing the air gun 36 for insertion into cavity 42 the first right angle elbow 60 is threaded into air inlet opening 38 of the air gun and it is tightened to the extent necessary to prevent air leakage when the valve 52 is turned on. Thus partially assembled, the air gun 36 is inserted into cavity 42, first elbow 60 is the first to enter, until the elbow reaches a depth to place the threaded mouth 72 adjacent opening 62.

Then the air gun 36 is rotated with respect to housing 32 until the open mouth 72 of first elbow 60 is visible through housing opening 62. At that physical location the center of the open mouth 72 will be aligned within a horizontal plane extending through the axis or center of opening 62 and the button 44 will be aligned with the set screw 46 threaded through the opposite sidewall of housing 32. It will be understood that visual sighting of the open mouth 72 may not be necessary because the angular orientation of the housing with respect to the air gun could be accomplished by having aligned exterior markings, any number of such optional features would be appropriate. In any case, after the housing and air gun are in proper angular orientation the second right angle elbow 58 is inserted through opening 62 and threaded into fluid tight engagement with the open mouth 72 of the first right angle elbow 60.

After elbow 58 is threaded into mouth 72 the terminal end or impact seat 34 of rod 22 is inserted through sleeve 28 into firm contact with a face of elbow 60. The impact seat 34 absorbs a substantial portion of the impacts from the reciprocating piston and minimizes shear forces on the nipple of elbow 58 projecting through opening 62 and grommet 63.

Figure 3:
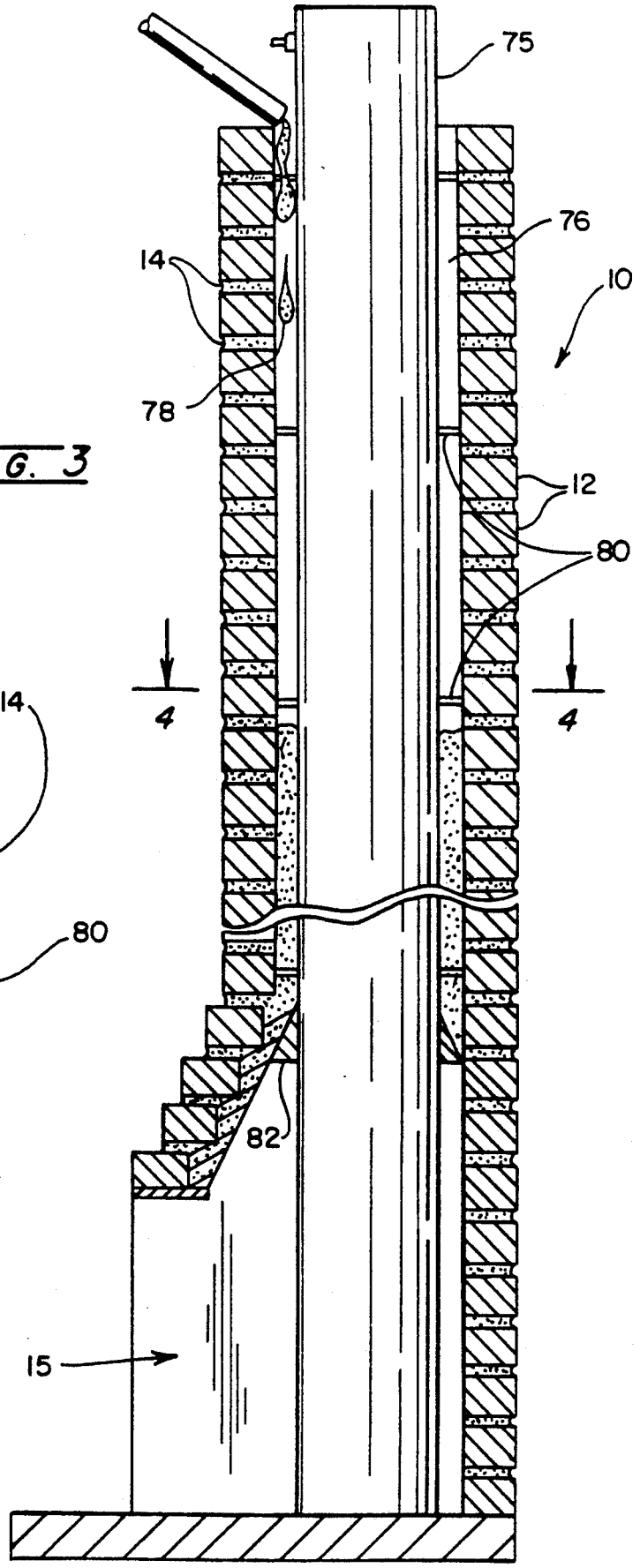
FIG. 3 is a partial sectional view of a chimney having a flexible inflatable concrete form inside a chimney and showing grout being deposited between the form and the chimney sidewall.
Figure 4:
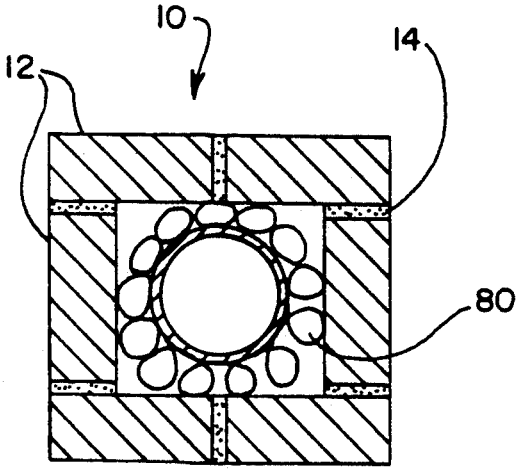
FIG. 4 is a sectional view taken along line 4—4 of FIG. 3.

In the operational use of the chiseling device of this invention to reline a chimney, as best illustrated in FIGS. 1 and 3, the old lining 16 will be removed by the reciprocating chisel 64 which will extend between the lining 16 and the sidewall of the chimney and the angled portion 66 will serve as a lever to crack and chip the lining and cause it to fall into the chimney downwardly to a substrate to receive the same or into the firebox itself. After the liner has been removed, the interior of the chimney will be smoothed by the chisel or a hammer or other means which will remove projections or burrs 74 from the sidewalls of the chimney as needed to prevent tearing of a flexible inflatable concrete mold. The purpose is to make a smooth surface for the insertion of a flexible inflatable concrete mold 75 which may be placed within the chimney to leave a small space 76 between the mold 75 and the chimney sidewall to allow a fluid grout 78 to be poured into the space to form the new lining. After the lining has properly set, the mold 75 can be deflated and removed from the chimney and the fireplace is ready for reuse.

To prevent the flexible mold 75 from flopping around the inside of the chimney, spacers 80 are provided inside the chimney to hold the mold 75 away from the sidewalls. A wedge shaped block 82 is secured in place at the upper section of the firebox 15 to prevent grout 78 from escaping space 76.

After the mold 75 has been removed, any voids or imperfections in the lining surface are repaired by the application of additional grout by use of a trowel which is spring biased and mounted on the end of an elongated rod similar to rod 22. Such an apparatus is disclosed in my co-pending patent application filed simultaneously herewith, application Ser. No. 685,050 and to the extent necessary for understanding this invention such is incorporated herein by reference.

An angle joint 84 allows the axis of the lower end 26 of rod 22 to be set at an intersecting angle with respect to the axis of the upper section 24 of rod 22. This angular relationship allows the tool of this invention to turn corners in the chimney, if such exist. Mirrors or video cameras may be utilized to view the chiseling operation where it is not within the line of sight of the worker. The worker will calculate the angle within the chimney, loosen bolt 86 to angularly adjust ends 24 and 26, and then tighten bolt 86 to lock the rod at the desired angle.

Having described the invention in its preferred embodiment, it will be understood that certain modifications may be made in the apparatus and the procedural steps described without departing from the spirit of the invention. It is not intended that the words used to describe the invention, nor the drawings used to illustrate the same, be limiting on the invention itself. Rather it is intended that the invention be limited only by the scope of the appended claims.

I claim:

1. Chiseling apparatus for use in a chimney comprising, an elongated positioning rod having a handle end and a free end, said rod having an axis, said free end being connected to a cylindrical housing coaxially aligned with the axis of the free end of said positioning rod, an air driven piston and cylinder combination being mechanically mounted within said housing, said piston being configured to reciprocate within said cylinder in response to air under pressure delivered to said cylinder, said cylinder including an air inlet opening located within said housing and a piston rod opening facing away from said free end of said positioning rod, a piston rod connected to said piston and extending through said piston rod opening in said cylinder and beyond said housing, a chisel connected to reciprocate with said piston and piston rod, said chisel including a chisel edge for impacting on surfaces within said chimney, said chisel edge being off-set from the axis of said housing, an opening through said housing, said housing opening circumscribing an air duct, said duct being connected in fluid communication both with a source of high pressure air and with said air inlet opening in said cylinder, said duct extending along said positioning rod within said chimney, said handle end of said positioning rod extending upwardly from said chimney, a valve in said duct intermediate said air source and said cylinder for opening and closing said duct to air flow, said valve being located near said handle end of said positioning rod.

2. The apparatus of claim 1 including an angle joint in said positioning rod intermediate said handle end and said free end, means for locking said angle joint in rigid position with the axes of the free end and handle end projecting at an angle to each other to allow said chiseling apparatus to traverse and operate within a chimney which is not vertically aligned for its full length.

3. The apparatus of claim 2 wherein said duct includes a first elbow connected into said air inlet opening in said cylinder and having a threaded surface facing said housing opening, a second elbow extending through said housing opening into threaded engagement with said first elbow, said second elbow also being connected to a flexible hose, said flexible hose extending from said second elbow to said valve, said flexible hose forming part of said duct.

4. The apparatus of claim 3 including means forming a depth location impact seat inside said housing for engaging said first elbow at a depth of insertion of said cylinder into said housing to align said threaded surface on said first elbow with a plane extending through said housing opening and absorb impacts to the apparatus from reciprocation of said piston.

5. The apparatus of claim 4 including a plurality of set screws threaded through threaded holes in said housing sidewall to engage said cylinder and lock it in position within said housing.

6. The apparatus of claim 2 including a plurality of set screws threaded through threaded holes in said housing sidewall to engage said cylinder and lock it in position within said housing.

7. The apparatus of claim 3 including a plurality of set screws threaded through threaded holes in said housing sidewall to engage said cylinder and lock it in position within said housing.

8. The apparatus of claim 1 wherein said duct includes a first elbow connected into said air inlet opening in said cylinder and having a threaded surface facing said housing opening, a second elbow extending through said housing opening into threaded engagement with said first elbow, said second elbow also being connected to a flexible hose, said flexible hose extending from said second elbow to said valve, said flexible hose forming part of said duct.

9. The apparatus of claim 8 including means forming a depth location impact seat inside said housing for engaging said first elbow at a depth of insertion of said cylinder into said housing to align said threaded surface on said first elbow with a plane extending through said housing opening and absorb impacts to the apparatus from reciprocation of said piston.

10. The apparatus of claim 9 including a plurality of set screws threaded through threaded holes in said housing sidewall to engage said cylinder and lock it in position within said housing.

11. The apparatus of claim 8 including a plurality of set screws threaded through threaded holes in said housing sidewall to engage said cylinder and lock it in position within said housing.

12. The apparatus of claim 1 including a plurality of set screws threaded through threaded holes in said housing sidewall to engage said cylinder and lock it in position within said housing.

* * * * *